US010364088B2

(12) United States Patent
van Esch

(10) Patent No.: US 10,364,088 B2
(45) Date of Patent: Jul. 30, 2019

(54) TAPE HOLDING INFORMATION CARDS AND BLISTER AND AN INFORMATION CARD FOR USE WITH SUCH TAPE

(71) Applicant: 4C Care IP B.V., Riethoven (NL)

(72) Inventor: Josephus Jacobus Johannes Maria van Esch, Riethoven (NL)

(73) Assignee: PL2M B.V., Riethoven (NL)

( * ) Notice: Subject to any disclaimer, the term of this patent is extended or adjusted under 35 U.S.C. 154(b) by 0 days.

(21) Appl. No.: 14/892,585

(22) PCT Filed: May 19, 2014

(86) PCT No.: PCT/EP2014/001341
§ 371 (c)(1),
(2) Date: Nov. 20, 2015

(87) PCT Pub. No.: WO2014/187552
PCT Pub. Date: Nov. 27, 2014

(65) Prior Publication Data

US 2016/0122119 A1 May 5, 2016
US 2016/0355321 A9 Dec. 8, 2016

(30) Foreign Application Priority Data

May 21, 2013 (EP) ..... 13002632

(51) Int. Cl.
*B65D 75/32* (2006.01)
*B65D 83/04* (2006.01)
(Continued)

(52) U.S. Cl.
CPC ..... *B65D 83/0472* (2013.01); *A61J 1/035* (2013.01); *B65B 15/04* (2013.01); *B65B 61/202* (2013.01);
(Continued)

(58) Field of Classification Search
CPC . A61J 1/035; B65D 73/0042; B65D 73/0057; B65D 73/02; B65D 83/0463;
(Continued)

(56) References Cited

U.S. PATENT DOCUMENTS 3,282,413 A * 11/1966 Sparks ..... B65D 75/327 206/462
3,380,578 A 4/1968 Sparks
(Continued)

FOREIGN PATENT DOCUMENTS

CA 2318549 A1 * 5/2000 ..... B65D 75/527
NL 1033807 C2 11/2008
(Continued)

OTHER PUBLICATIONS

International Search Report for related PCT Application No. PCT/EP2014/001341 dated Jan. 7, 2015.

*Primary Examiner* — Mollie Impink
(74) *Attorney, Agent, or Firm* — Troutman Sanders LLP; Ryan A. Schneider; Christopher Close, Jr.

(57) ABSTRACT

A tape for holding an information card (5) holding a blister (1) having a cavity for holding an item, where a hole (7) in the information card allows affixing of the blister such that the cavity of the blister remains accessible for instance by inserting the cavity of the blister in the hole so it protrudes through the information card. By affixing the information cards in a repetitive pattern along the tape (20) the assembled tape can be folded and individual blisters are no longer lost. An edge (6) for severing the tape allows the removal of a single information card-blister assembly from the assembled tape. Separating the information cards on the tape allows room for folding the tape. Ensuring that the holes cut in the tape do not overlap allows the distance between the information cards along the tape to be reduced
(Continued)

and result in an efficient stacking of the blisters when the tape is folded.

12 Claims, 8 Drawing Sheets

(51) Int. Cl.

| | |
|---|---|
| ***B65D 73/00*** | (2006.01) |
| ***G07F 17/00*** | (2006.01) |
| ***A61J 1/03*** | (2006.01) |
| ***B65B 15/04*** | (2006.01) |
| ***B65B 61/20*** | (2006.01) |
| *B65B 61/06* | (2006.01) |

(52) U.S. Cl.
CPC ..... *B65D 73/0057* (2013.01); *B65D 75/326* (2013.01); *G07F 17/0092* (2013.01); *A61J 2205/30* (2013.01); *B65B 61/06* (2013.01); *B65D 73/0042* (2013.01); *B65D 2203/00* (2013.01)

(58) Field of Classification Search
CPC ..... B65D 83/0472; B65D 75/367; B65D 75/327; G07F 17/0092
USPC ..... 206/462, 713
See application file for complete search history.

(56) References Cited

U.S. PATENT DOCUMENTS 3,840,114 A * 10/1974 Sama ..... B65D 73/00 206/461
3,856,144 A * 12/1974 Kelly ..... B65D 75/327 206/462
4,398,635 A * 8/1983 Hirt ..... B65D 75/327 206/532
8,403,212 B2 3/2013 Van Esch

FOREIGN PATENT DOCUMENTS

WO 2003089313 A2 10/2003
WO 2010095102 A1 8/2010

* cited by examiner

TAPE HOLDING INFORMATION CARDS AND BLISTER AND AN INFORMATION CARD FOR USE WITH SUCH TAPE

CROSS-REFERENCE TO RELATED APPLICATIONS

This application is a US National Stage of International Application No. PCT/EP2014/001341, filed 19 May 2014, which claims the benefit of EP 13002632.1, filed 19 May 2013.

TECHNICAL FIELD OF THE INVENTION

This invention relates to a tape for holding an information card holding a blister having a cavity for holding an item, where a hole in the information card allows affixing of the blister such that the cavity of the blister remains accessible for instance by inserting the cavity of the blister in the hole so it protrudes through the information card.

BACKGROUND ART

The packaging of items not only protects the item from the environment up to the point of use but also often provides information about the safe use of the item.

This is especially true for pharmaceuticals where the packaging contains information about the application of the pharmaceutical, and have a registration number to identify the pharmaceutical, expiration date for quality control, a charge or lot number to allow traceability and often also a barcode for machine readability. The packaging also provides protection of the pharmaceutical against environmental influences to prevent deterioration between the moment of production and the moment of application (administering).

A common type of packaging for one or more doses is a blister. This is basically a cavity formed around the pharmaceutical dose by two layers that are meet around the dose and form a seal where they meet. The dose can be removed from the cavity by applying pressure to one side of the cavity and either forcing the seal apart or fracturing or rupturing of one of the two layers.

A typical blister has a rupturable surface on the back of the blister made of a thin metal foil. Pharmaceuticals are known to be repackaged. In such a repackaging operation either the entire non-severed blister with multiple doses is being inserted into a new external package or the dose is being removed from the blister and put into another blister or a container of another kind.

Repackaging introduces problems in the traceability of the pharmaceuticals.

To provide room for extra information while leaving the manufacturer's packaging intact U.S. Pat. No. 8,403,212 discloses an information card for attaching to a blister holding an item such as a pharmaceutical dose. The information card comprises a rim area around an opening in the information card for attaching the information card to the blister, the opening allowing the information card to be positioned around the item. This allows additional information to be added to the blister while leaving the protective blister intact.

Such information cards allow proper tracking of the item in the blister in factories, during transport, in the shop but also for instance in a hospital environment where closed loop administration of pharmaceuticals improves patient safety.

In U.S. Pat. No. 8,403,212 an information card is attached to the manufacturer's intact packaging. The information card provides the information about the pharmaceutical with each individual dose in order to ensure the correct administering of the pharmaceutical to the patient.

As the information card disclosed in U.S. Pat. No. 8,403,212 holds a single dose it has the disadvantage that the information card must be handled individually, introducing the risk of loss.

DISCLOSURE OF INVENTION

To overcome this disadvantage a tape is provided that is characterized in that the information cards are affixed to the tape in a repetitive pattern along the tape.

By having multiple information cards attached to a single tape the information cards are kept together and can thus not be lost.

Affixing the information cards in a repetitive manner further enhances the processing of the tape by machine.

In an embodiment the tape comprises a first hole aligned with a hole of a first information card and a second hole aligned with a hole of a second information card.

Providing aligned holes in the tape and information cards allows the attachment of a blister. The blister's cavity can protrude through the aligned hole or the blister's seal can be placed over the aligned holes. The item or dose can thus still be removed from the cavity by applying pressure to one side of the cavity and either forcing the seal apart or fracturing one of the two layers.

As neither the tape nor the information card have material where the blister's seal is located, the blister's layer meant to fracture for opening can still be fractured. This ensures that the item or dose does not need to be repackaged.

In an embodiment of the tape the cavity of the first blister protrudes through the first hole and the cavity of the second blister protrudes through the second hole.

By affixing the blister to the tape such that the cavity protrudes through the hole, the seal can be forced apart or if applicable, one of the two layers can still be fractured.

Most blisters are constructed such that the one wall and sides of the cavity are formed by a sturdy material while one wall is formed by a layer that can be ripped or fractured such as a thin metal foil. As the sturdy material is attached to the tape or information card, the a layer that can be ripped or fractured is exposed is not covered by material that could hinder the opening of the blister.

In a further embodiment of the tape a distance between the information cards accommodates folding of the tape.

Increasing the distance between information cards when affixed to the tape allows the tape to be folded in a way that the information cards and blisters are stacked. The distance between the information cards corresponds to distance between the information cards caused by the height of the cavity when stacking the information cards.

In an embodiment of the tape the distance is equal or larger than a height of the cavity. When stacking the information cards and blisters by folding the tape a distance of at least the height of the cavity or the protrusion of the cavity through the tape is created which can be bridged by the tape when extra space between the information cards is provided on the tape.

In an embodiment of the tape the hole in the information cards is restricted to a first half of the information card.

This allows the information cards to be oriented on the tape such that by folding the tape the cavity of the blister of the first information card is positioned adjacent to an area of the second information card without protrusion of the cavity of the blister of the second information card. By dividing the information card in two halves, one half having the hole for the protrusion of the cavity of the blister and the other half being suitable for the placement of information the spacing between the information cards is reduced, allowing more blisters to be stored in a given volume.

In an embodiment the information cards are oriented in one direction.

Having the information cards affixed in a single orientation allows for easy processing by machine.

This can be achieved by orienting the information cards along the tape such that of the first information card the half having the hole is positioned adjacent to the half not having a hole of the second information card.

An embodiment of the information card of the present invention is characterized in that an edge of the information card is a cutting edge arranged for severing a tape.

This cutting edge allows an information card to be manually separated from the other information cards by severing the tape using the edge. No tools such as scissors are thus needed to remove an information card from the other information cards.

There is also no need to peel the tape from the information card as this can be tedious.

It ensures that the information card and attached blister are not damaged when separating them from the other information cards on the tape. As the edge and tape are controlled by the manufacturer, the forces, mechanism and dynamics of the cutting of the tape by the edge can be precisely controlled by choice of tape material, information card material and edge type. When this description uses the word cutting it implicitly also means severing and vice versa.

In an embodiment of the information card the edge is a crenate edge.

A crenate edge can be designed to cut a tape. The crenate edge results in a shape of the edge that can cut through the tape but limits the effectiveness of the cutting action on other materials.

In an embodiment of the information card the edge is a toothed edge.

An edge as known from a tape dispenser with fine teeth can be used as the cutting edge of the information card.

In an embodiment of the information card the edge is a sharp edge.

A sharp edge can be used to cut the tape but is more suitable in an environment where the tape is processed by machine as a sharp edge requires carefulness by a person handling the information card manually.

In an embodiment of the information card the edge is a serrated edge.

A serrated edge can be used to cut the tape.

In an embodiment of the information card the hole in the information cards is restricted to a first half of the information card.

This allows the information cards to be oriented on the tape such that by folding the tape the cavity of the blister of the first information card is positioned adjacent to an area of the second information card without protrusion of the cavity of the blister of the second information card. By dividing the information card in two halves, one half having the hole for the protrusion of the cavity of the blister and the other half being suitable for the placement of information the spacing between the information cards is reduced, allowing more blisters to be stored in a given volume.

A holder for a tape according to the invention holds the tape in a folded state such that the information cards and blisters are stacked saving space.

A machine for packaging comprising a holder according to the invention can be build more compact as the holders for the various tapes require less space than a common reel holding such tape as the folding of the tape optimally uses the available volume.

MODES FOR CARRYING OUT THE INVENTION

Figure 3:
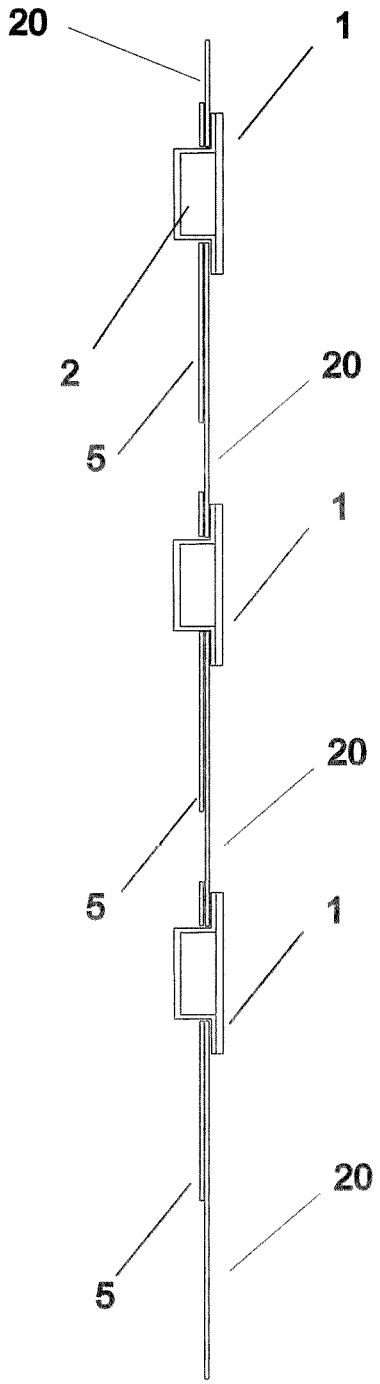
FIG. 3 shows a tape having the information cards attached to one side and the blister attached to the other side.
Figure 4:
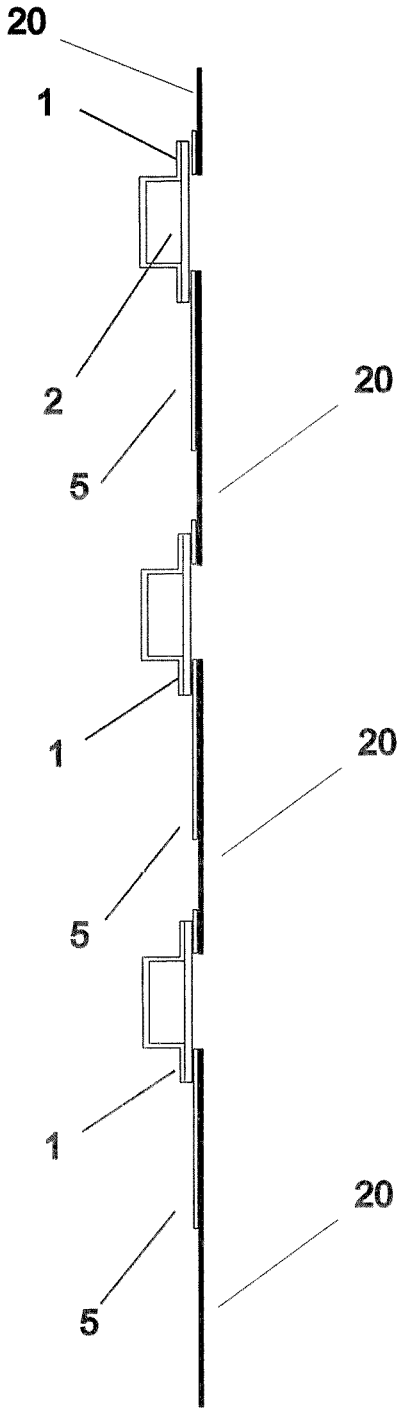
FIG. 4 shows a tape having the information cards and blisters attached to the same side of the tape.

Although the description of the best mode for carrying out the invention uses two specific ways of assembling the tape assembly (blister affixed to top of information card affixed to top of tape, and information card affixed to top of tape and blister affixed to back of tape with cavity protruding through the hole) other stacking sequences than the ones shown are envisaged although they are less advantageous than the two stackings used in the FIGS. 3 and 4. For instance the blister can be affixed to the back of the information card (with the cavity of the blister protruding through the hole in the information card) and this information card-blister assembly can subsequently be affixed to the front or back of the tape. Although feasable the blister will create a small separation between the information card and the tape which might introduce difficulties when affixing the information card to the tape. Hence the best mode of stacking is shown in FIGS. 3 and 4 but this should not be construed as a limitation to the present invention.

Figure 1:
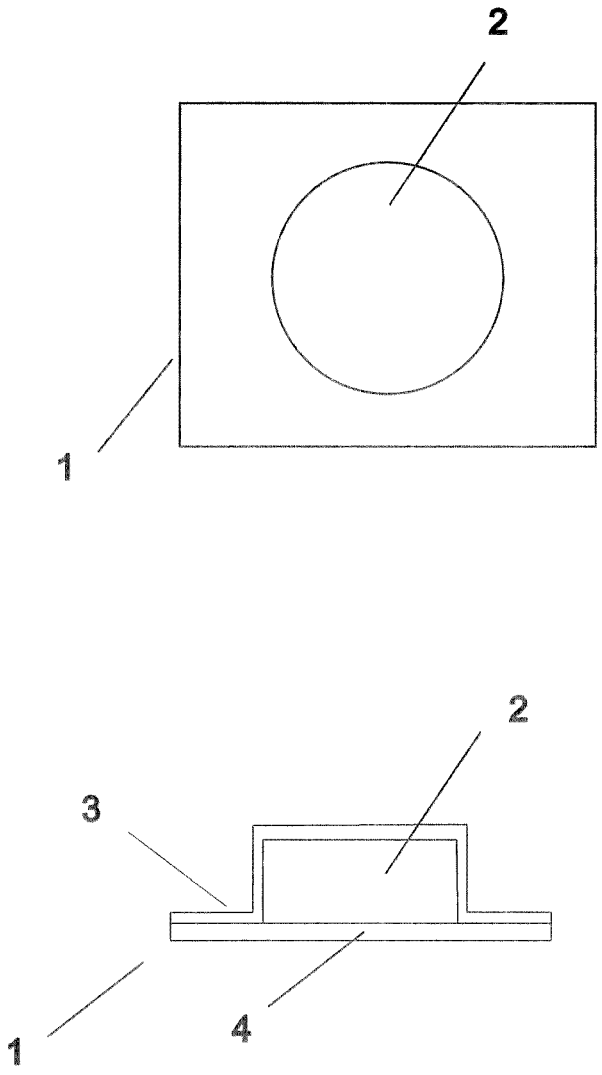
FIG. 1 shows a blister holding an item.

FIG. 1 shows a blister for holding an item.

The blister 1 comprises a cavity 2 in which an item such as a pharmaceutical dose is placed. A typical blister 1 is formed from two sheets 3, 4 of which a first sheet 3 is formed to form the cavity 2 and the second sheet 4 is applied to close the cavity 2. When pressure is applied to the top of the cavity 2, cavity 2 deforms and the item in the cavity 2 is pushed against the second sheet 4, leading to a rupturing of the second sheet. This allows the removal of the item from the blister 1. A typical material for the second sheet 4 is a metal foil but other material are also possible. Other blisters are opened by severing the connection between the first sheet 3 and the second sheet 4.

Although the second sheet 4 is flat in the blister shown throughout this description, the invention can also be applied to other blisters, for instance a blister where both the first sheet 3 and the second sheet 4 form a cavity, i.e. where the second sheet is not flat as shown but also contributes to the volume of the cavity.

The blister shown is a single item/dose blister. Many blisters have multiple cavities each holding a single dose.

Figure 2:
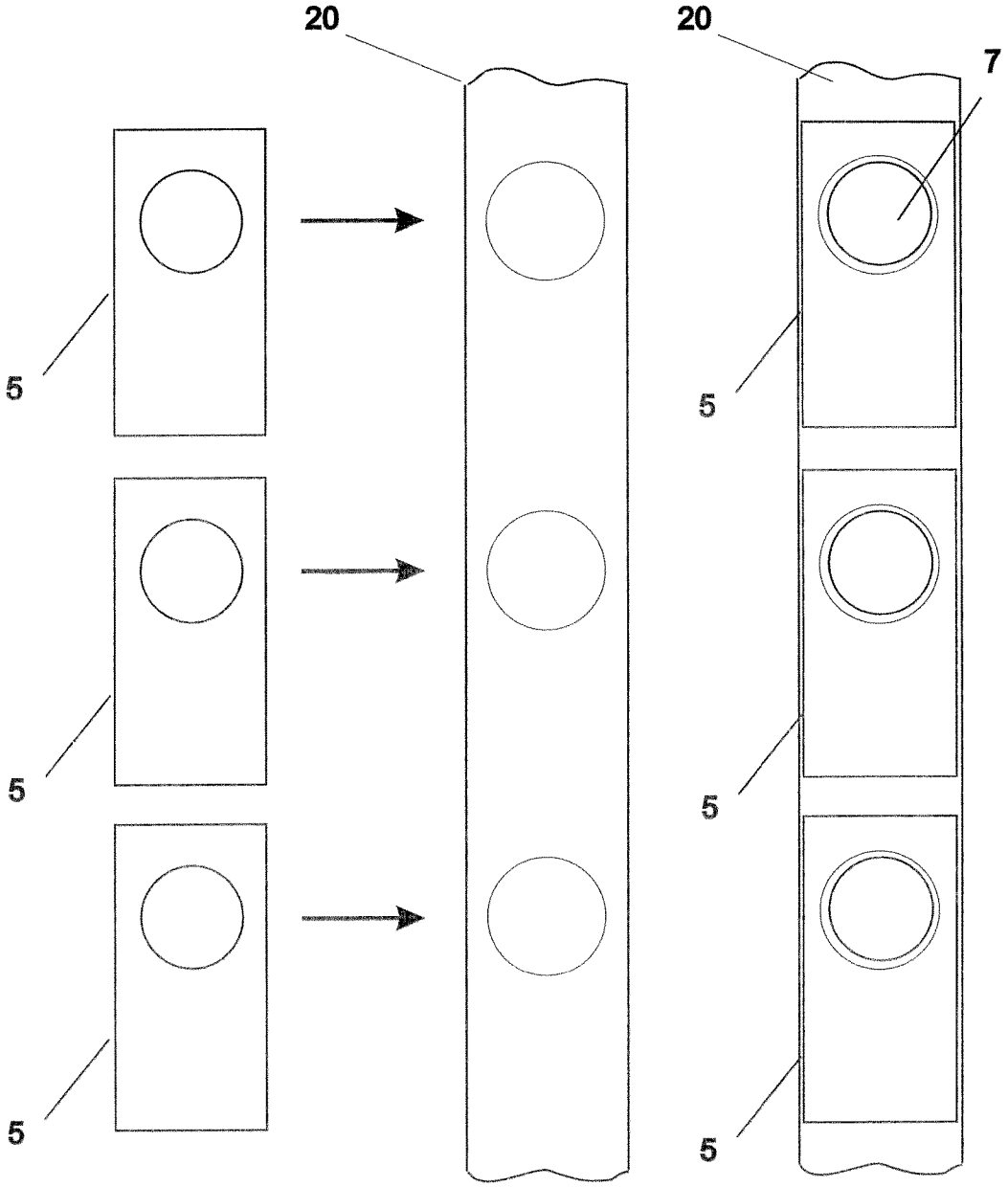
FIG. 2 shows the assembly of a tape.

One of the steps of the repackaging consists of the cutting into single cavity sections of the multi cavity blisters as disclosed in FIGS. 1 and 2 of U.S. Pat. No. 8,403,212.

FIG. 2 shows the assembly of a tape.

The information cards 5 are placed on the tape, aligned with openings 21 in the tape 20. The information cards 5 are subsequently affixed to the tape 20. This can be achieved using glue or by heat or ultrasonic welding to fuse the information card and tape together.

Instead of aligning the holes in the tape 20 with the holes of the information cards 5 the information cards 5 and tape 20 can also be produced without holes, simplifying the assembly process of the tape 20 as the holes are cut only when the information cards 5 are affixed to the tape. This ensures that there are no alignment problems and that the holes 7 are of identical size.

It also saves a cutting step as the information cards 5 and the tape are no longer cut separately.

As will become evident from FIGS. 3 and 4, the information card 5 can be placed on the front or the back of the tape 20. For the information on the information card 5 to remain readable when attached to the back of the tape 20, it is evident that the tape is to be at least partially transparent.

Alternatively information on the information card 5 can be duplicated on the tape 20 in case the information on the information card 5 becomes in accessible because the tape 20 is not transparent. When the back of the information card 5 is affixed to the front of the tape 20 as shown in FIG. 3, the information remains readable.

Although the blister is not shown in FIG. 2, it is also possible to affix the blister to the information card before affixing the information card to the tape instead of first affixing the information card 5 to the tape 20 and subsequently affixing the blister to tape 20 or information card 5.

Having the information cards arranged as shown in FIG. 2 allows the tape to be folded between the information cards 5 and the cavity of the blister of the information card consequently becoming positioned adjacent to an area of the adjacent information card without protrusion of the cavity. By dividing the information card in two halves, one half having the hole for the protrusion of the cavity of the blister and the other half being suitable for the placement of information the spacing between the information cards is reduced, allowing more blisters to be stored in a given volume.

Figure 5:
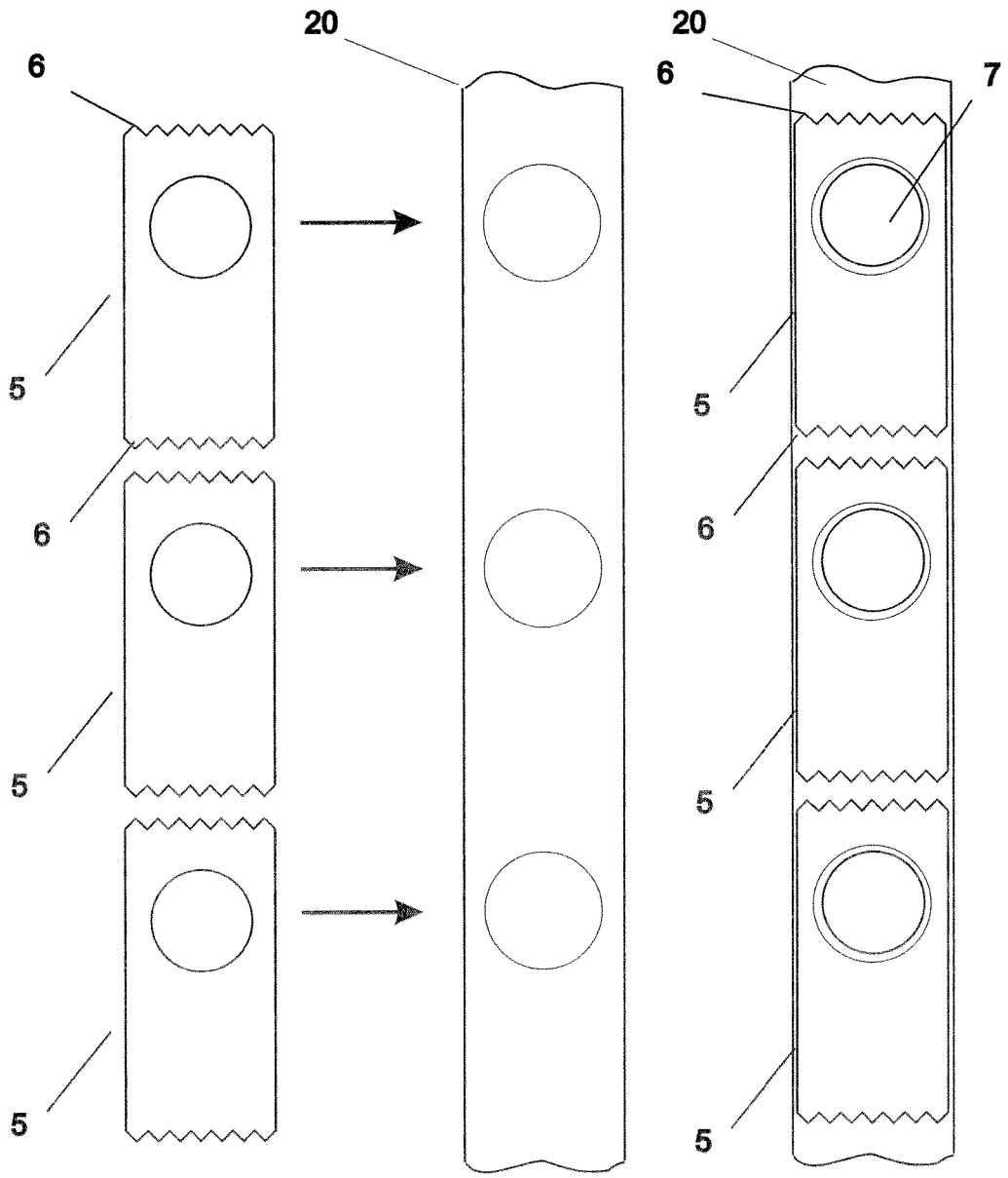
FIG. 5 shows the assembly of a tape with information cards having an edge for severing the tape.

As the blister can be affixed in two ways (on top of the information card or tape or from the back of the tape with the cavity protruding through the hole 7 in the tape and information card) only the intermediate tape assembly (tape plus information card affixed to it) is shown in FIG. 5.

Furthermore the information cards and tape show holes before being assembled but it is evident from the description that the holes 7 can also be cut after the information cards 5 have been affixed to the tape 20. Also the hole in the tape is drawn larger than the hole in the information card but this is merely done to show both cuts in the drawing of the intermediate tape assembly and is not to be understood as a limitation in the choice of the size of the holes.

FIG. 3 shows a tape having the information cards attached to one side and the blister attached to the other side.

The cross section of the tape in the longitudinal direction shown in FIG. 3 shows the information card 5 affixed to the front of the tape 20. The information card 5 in this case is first affixed to the tape 20. In a preferred embodiment the holes are subsequently cut in the information card-tape assembly. In a final step the blister 1 is inserted from the back side of the tape 20 into the holes and affixed to the tape 20. As can be seen in FIG. 3 this results in the protrusion of the first sheet 3 (and thus of the cavity 2) of the blister 1 protruding through the hole, while the second sheet 4 of the blister 1 remaining fully accessible at the back of the tape 20. Thus the manufacturers text on the second sheet 4 of the blister 1 remains fully readable and the rupturing of this second sheet 4 when expelling the item from the cavity 2 is not hindered.

The item can thus still be expelled from the blister 1 with the same technique and force as a blister that has not been attached to a tape according to the present invention. As the front of the information card 5 is not covered (only the back is covered by the tape 20) all information remains fully readable, or, if no information was present yet, the area is fully accessible to apply the information to after the affixing to the tape 20 o the information card 5.

As the information card 5 and blister 1 are affixed to the tape 20 independently, the sequence of assembly of the tape 20 into the final product can be modified by first affixing the blister 1 to the tape 20 before affixing the information card 5 to the tape 20.

As the information cards 5 are positioned as in FIG. 2, the tape assembly benefits from the same advantage when folding the tape as discussed for FIG. 2.

FIG. 4 shows a tape having the information cards and blisters attached to the same side of the tape.

Contrary to FIG. 3, the blister in FIG. 4 is affixed to the front of the information card 5. The final assembly of the tape 20 can be achieved in varies ways. It is possible to first affix the information card 5 to the front of the tape 20 and subsequently affixing the blister 1 to the front of the information card 5. This would allow the holes through the tape 20 and information card 5 to be cut after the information card 5 is affixed to the tape, benefiting from the advantageous mentioned in FIG. 2. Alternatively the blister can be first affixed to the front of the information card 5 and subsequently the information card 5 plus blister 1 can be affixed to the front of the tape 20. For this the hole in the information card 5 must be cut before the blister 1 is affixed and the hole in the tape can thus be cut only independently. The hole in the tape 20 and information card 5 ensure that the information on the second sheet 4 of the blister remains readable and that the mechanism of expelling the item trough the rupturing of the second sheet 4 of the blister 1 remains possible as the rupturing area of the blister 1 remains uncovered.

As the information cards 5 are positioned as in FIG. 2, the tape assembly benefits from the same advantage when folding the tape as discussed for FIG. 2

FIG. 5 shows the assembly of a tape with information cards having an edge for severing the tape.

The edge 6 of the information card 5 is modified as to obtain an edge that allows the severing of the tape 20. The first sheet 3 of the blister 1 is made of a sturdier material than the second sheet 4 and can thus be provided with either a sharp edge or a profile allowing the severing of the tape 20. Such edges include crenate, toothed or serrated edges. The user can manually use the edge 6 instead of a tool to sever the tape 20 or a machine can use it instead of a build-in cutter.

Such an information card 5 with an edge that allows the severing of the tape 20 can be used in all variations of the construction of the tape-information card-blister assembly as discussed in FIG. 3 or 4.

Having the information cards arranged as shown in FIG. 5 allows the tape to be folded between the information cards 5 and the cavity of the blister of the information card consequently becoming positioned adjacent to an area of the adjacent information card without protrusion of the cavity. By dividing the information card in two halves, one half having the hole 7 for the protrusion of the cavity of the blister (or for allowing access to the rupturable surface of the blister when the blister is attached to the front of the information card) and the other half being suitable for the placement of information the spacing between the information cards 5 is reduced, allowing more blisters to be stored in a given volume. As the blister can be affixed in two ways (on top of the information card or tape or from the back of the tape with the cavity protruding through the hole 7 in the tape and information card) only the intermediate tape assembly (tape plus information card affixed to it) is shown in FIG. 5.

Furthermore the information cards and tape show holes before being assembled but it is evident from the description that the holes 7 can also be cut after the information cards 5 have been affixed to the tape 20. Also the hole in the tape is drawn larger than the hole in the information card but this is merely done to show both cuts in the drawing of the intermediate tape assembly and is not to be understood as a limitation in the choice of the size of the holes.

Figure 6:
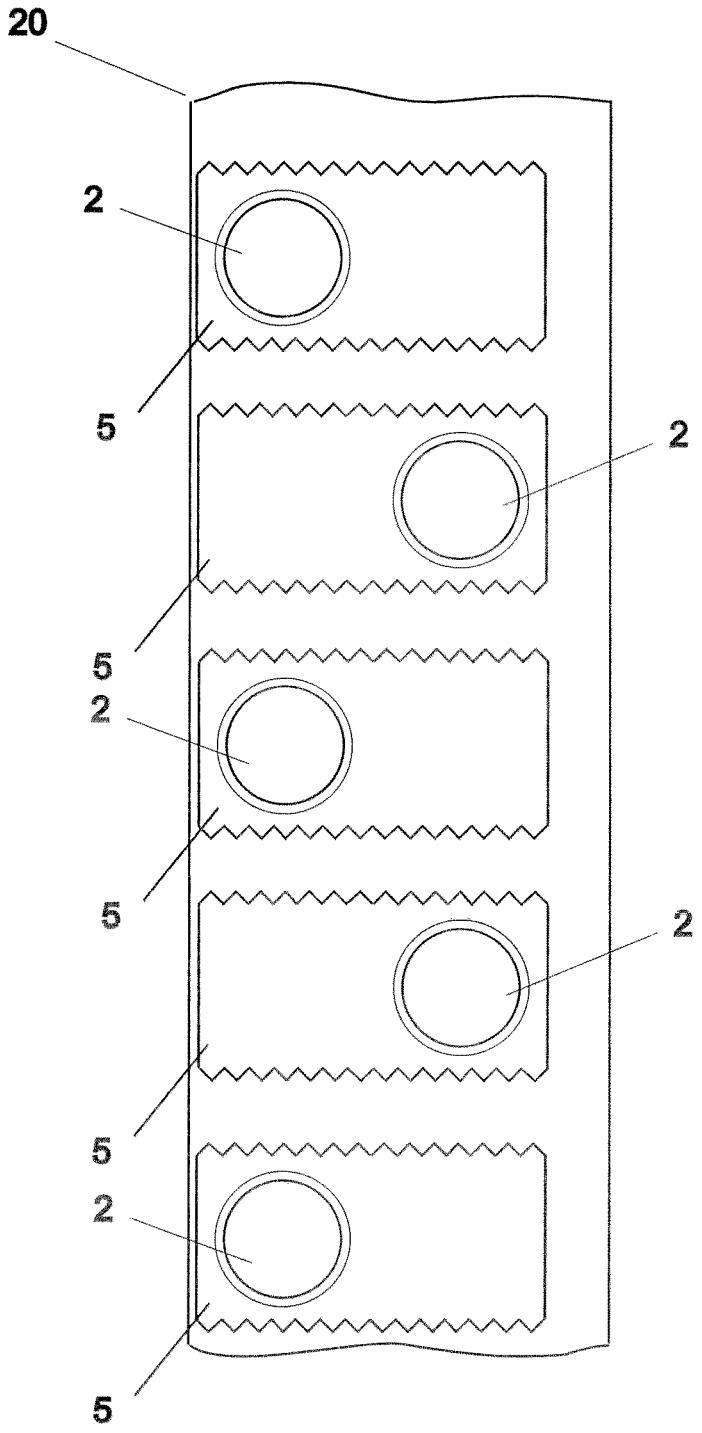
FIG. 6 shows an alternative layout of the information cards and blisters on the tape.

FIG. 6 shows an alternative layout of the information cards and blisters on the tape. Instead of arranging the information cards 5 with their longitudinal axis aligned along the longitudinal axis of the tape 20, the information cards can also be positioned with their longitudinal axis perpendicular to the longitudinal axis of the tape 20. Although it is possible to have all information cards 5 orientated identical, i.e. all cavities centered or towards the same side of the tape 20, having the information cards arranged as shown in FIG. 6 allows the tape to be folded between the information cards 5 and the cavity of the blister of the information card consequently becoming positioned adjacent to an area of the adjacent information card without protrusion of the cavity. By dividing the information card in two halves, one half having the hole for the protrusion of the cavity of the blister and the other half being suitable for the placement of information the spacing between the information cards is reduced, allowing more blisters to be stored in a given volume.

Figure 7:
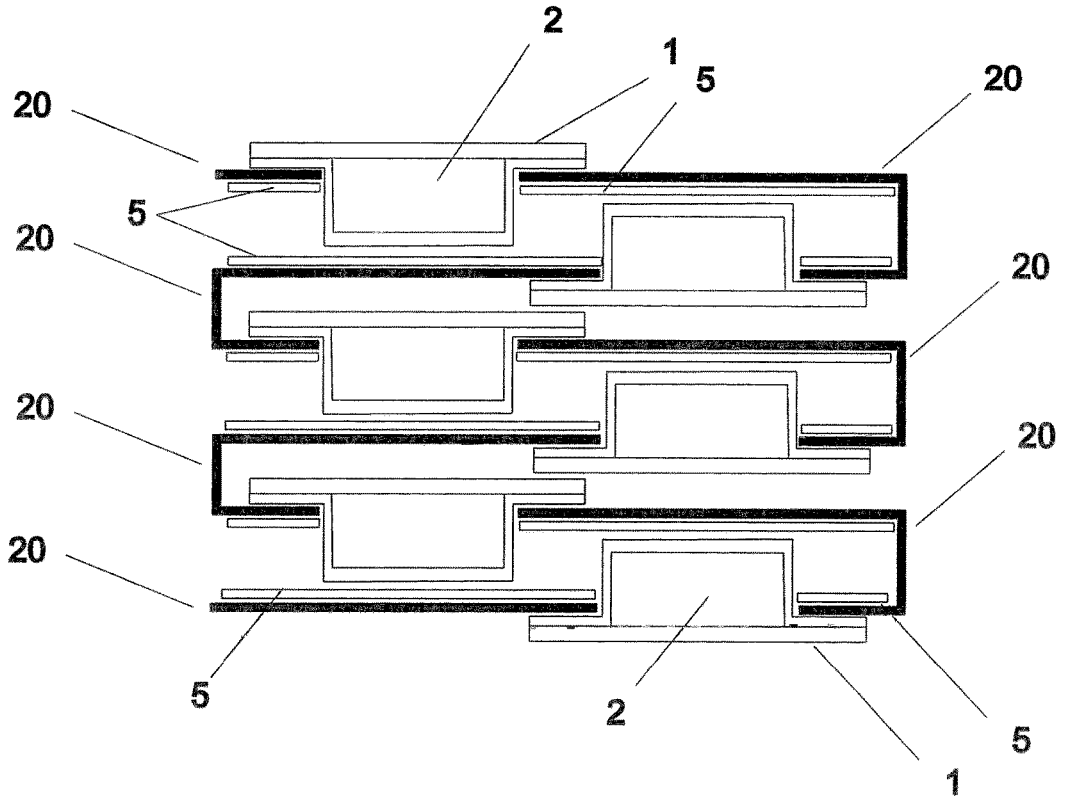
FIG. 7 shows a folded tape resulting in a stack of information cards and blisters.

FIG. 7 shows a folded tape resulting in a stack of information cards and blisters.

In this FIG. 6 information cards 5 with blisters 1 have been affixed to the tape 20 and the tape 20 has been subsequently folded between the information cards 5. Because of the arrangement of the information cards 5 and blisters 1 either the back of the blisters face each other, resulting in no waste of space, or the top of a blister cavity 2 is facing an information area of an adjacent information card 5. By ensuring that after folding the tape 20 adjacent holes do not overlap, adjacent information cards and blisters need not be separated more than the height of the blister cavity 2 when measured from the information card 5. This way twice as many blisters can be stored compared to a situation where adjacent holes on the tape 20 do overlap.

The arrangement of holes in FIG. 6 also ensures that adjacent holes do not overlap when the tape 20 is folded between the information cards 5.

Alternative configurations that comply with this adjacent holes do not overlap rule can be envisaged.

All figures in the present application show a uniform distance for ease of explanation but this must not be construed as a limitation because the distance between the information cards need not be uniform. As shown in FIG. 7 the distance needed for folding is smaller (as shown on the left side) when two adjacent blisters 1 end up with the back of the blisters 1 facing each other compared to when the top of a blister cavity 2 is facing an information area of an adjacent information card 5 and a greater distance must be bridged to allow a proper folding.

This reduces the amount of tape needed, of course at the expense of uniform distances between the information cards. When using the tape in a machine the machine has to take the varying distances into consideration.

Figure 8:
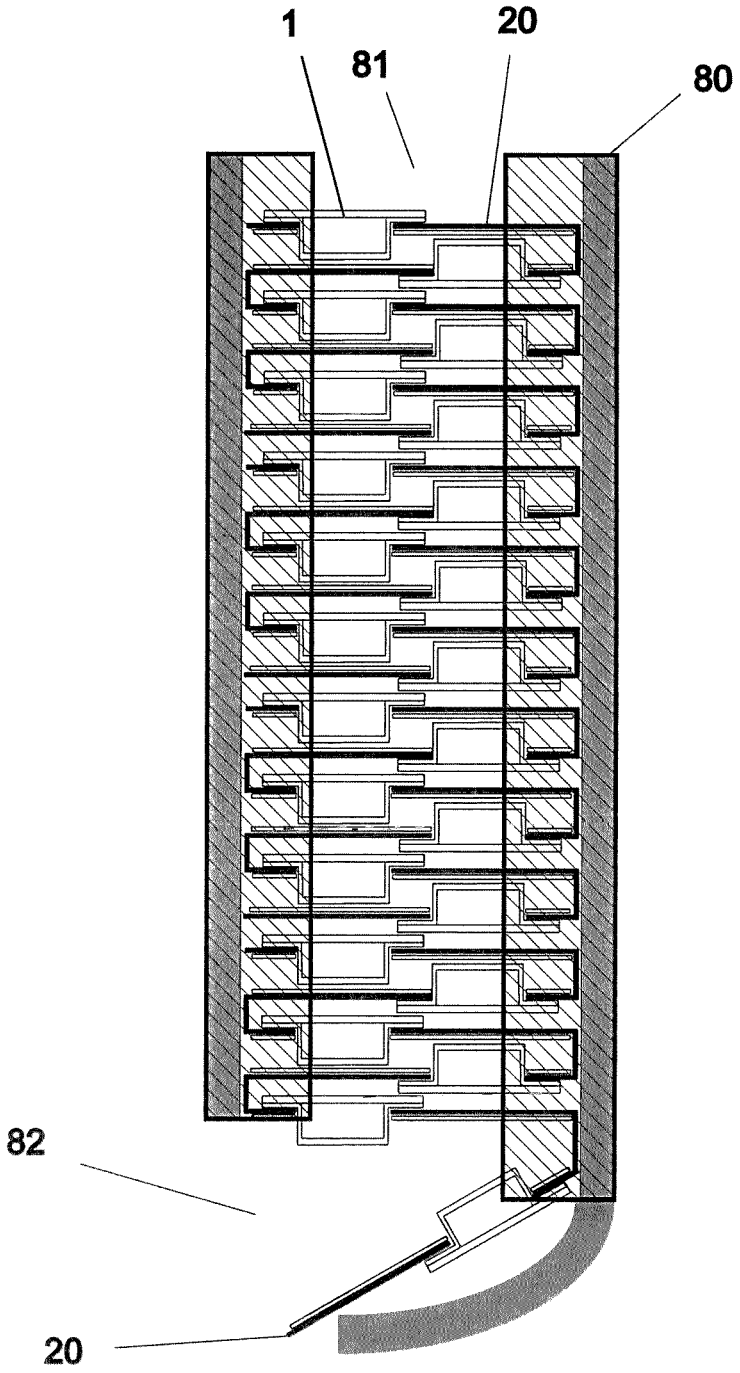
FIG. 8 shows a holder for the folded tape.

FIG. 8 shows a holder for the folded tape.

While FIG. 7 shows a limited stack of folded tape with 6 information cards and blisters, FIG. 8 shows a stack of 24 information cards and blisters 1 on a folded tape 20 inside a holder 80 for such a stack of folded tape 20. The holder 80 can be loaded through the opening 81 at the top of the holder, while at the bottom of the holder 80 an opening 82 is provided to pull the tape 20 from the holder 80.

As can be seen from FIG. 8, when pulling at the tape 20 for removing the bottom information card and blister, tension is created between the end of the information card to be removed and the edge of the next information card and the tape is automatically cut at the end of the next information card.

The opening 81 at the top of the holder allows the addition of more folded tape as needed while the current folded tape is being used up. This allows uninterrupted removal of information cards with blisters from the opening 82 at the bottom.

The invention claimed is:

1. A tape assembly comprising:

an elongate tape having a longitudinal axis;

a plurality of elongate-shaped information cards, each information card having edges and divided in two halves, a first half and a second half, with a hole arranged in the first half; and a plurality of blisters, each blister having a cavity holding an item, each blister affixed to a respective first half of an information card such that the cavity is in alignment with the hole and the hole allows access to the respective cavity of the blister;

wherein the second half of each information card is provided with information relating to the item in the cavity of the blister affixed to the first half of the same information card, the second half of each information card being without a blister;

wherein, in the longitudinal direction of the tape, the information cards are affixed to the tape in a repetitive pattern, wherein two adjacent information cards are always at a distance from each other, separated one from the other by a separation portion of the tape, so that each information card is bordered, at two opposite card edges, by the respective separation portion of the tape;

wherein the tape is a folded tape such that:

the blisters of the tape assembly are arranged in a stack; and each separation portion of the tape contains a fold, such that in respect to one information card, the two separation portions of the tape, one at each opposite card edge, are folded opposite from one another; and wherein, for a set of consecutive, adjacent first and second information cards, the first half of the first information cards is always aligned with the second half of the second information card, and the second half the first information card is always aligned with the first half of the second information card.

2. The tape assembly of claim 1, wherein the tape comprises holes aligned with the respective holes of the respective information cards.

3. The tape assembly as claimed in claim 2, wherein the cavity of each blister protrudes through the respective hole of the tape.

4. The tape assembly as claimed in claim 1, wherein all information cards are oriented with their longitudinal axes parallel to the longitudinal axis of the tape;

wherein each cavity of each blister has a height from a bottom to a ton of the blister; and wherein, for those adjacent information cards that are positioned in the stack with respective blister tops directed towards each other, the distance between adjacent information cards is equal to or larger than the heights of the cavities of the blisters.

5. The tape assembly as claimed in claim 4, wherein, for those adjacent information cards that are positioned in the stack with respective blister bottoms directed toward each other, the distance between adjacent information cards is smaller than the heights of the cavities of the blisters.

6. The tape assembly as claimed in claim 1, wherein all information cards are oriented with their longitudinal axes perpendicular to the longitudinal axis of the tape;

wherein each cavity of each blister has a height from a bottom to a top of the blister;

wherein adjacent information cards are rotated 180 degrees in the plane of the information cards; and wherein, for those adjacent information cards that are positioned in the stack with respective blister tops directed towards each other, the distance between adjacent information cards is equal to or larger than the heights of the cavities of the blisters.

7. The tape assembly as claimed in claim 6, wherein, for those adjacent information cards that are positioned in the stack with respective blister bottoms directed towards each other, the distance between adjacent information cards is smaller than the heights of the cavities of the blisters.

8. The tape assembly as claimed in claim 1, wherein at least one of the edges of each information card is a cutting edge arranged for severing the tape.

9. The tape assembly as claimed in claim 8, wherein the cutting edge of each information card is a toothed edge.

10. The tape assembly as claimed in claim 8, wherein the cutting edge of each information card is a sharp edge.

11. The tape assembly as claimed in claim 8, wherein the cutting edge of each information card is a serrated edge.

12. The tape assembly as claimed in claim 1, wherein the information cards are affixed to the tape by one of glue, heat, or ultrasonic welding.

* * * * *